United States Patent [19]

Baikie

[11] 3,934,892

[45] Jan. 27, 1976

[54] ICE SKATE

[75] Inventor: Hugh E. Baikie, Chateauguay Center, Canada

[73] Assignee: Kenbudge Holdings Limited, Canada

[22] Filed: June 20, 1974

[21] Appl. No.: 481,338

[30] Foreign Application Priority Data

May 7, 1974 Canada ..... 199191

[52] U.S. Cl. ..... 280/11.12

[51] Int. Cl.[2] ..... A63C 1/02

[58] Field of Search..... 280/11.12, 11.16, 11.17, 280/11.18, 11.14, 11.15, 7.13, 8, 11.1 R

[56] References Cited

UNITED STATES PATENTS

| | | | |
|---|---|---|---|
| 250,059 | 11/1881 | Dobson | 280/11.12 |
| 678,402 | 7/1901 | Jones | 280/11.12 |
| 814,819 | 3/1906 | Willis | 280/11.12 |
| 875,905 | 1/1908 | Fletcher | 280/11.17 |
| 1,319,094 | 10/1919 | Kerrigan | 280/11.18 |
| 1,405,981 | 2/1922 | Drevitson | 280/11.17 |
| 1,771,755 | 7/1930 | Heath | 280/11.12 |
| 2,179,852 | 11/1939 | Hirschman | 280/11.12 |
| 2,242,870 | 5/1941 | Prosey | 280/11.18 |

FOREIGN PATENTS OR APPLICATIONS

| | | | |
|---|---|---|---|
| 165,081 | 10/1958 | Sweden | 280/11.12 |

*Primary Examiner*—M. Henson Wood, Jr.
*Assistant Examiner*—David M. Mitchell
*Attorney, Agent, or Firm*—Craig & Antonelli

[57] ABSTRACT

A skate has a blade curved throughout its length to define a convex running edge. A pair of wall members have lower edges that are connected to the blade throughout its length, such wall members extending upwardly from the blade while diverging from each other. Horizontal flanges extend from upper edges of the wall members for securing to a boot sole to form a triangular structure therewith at least at front and rear portions of the skate and preferably the entire length thereof. The blade and said wall member define rounded end surfaces at the front and rear ends of the skate. Also disclosed is a combination skate and boot in which a molded plastic body forms a unitary structure defining a boot portion and a support portion. The support portion is triangular and projects downwardly from the boot portion while tapering inwardly to the socket in which the blade is mounted.

12 Claims, 14 Drawing Figures

Fig. 1.
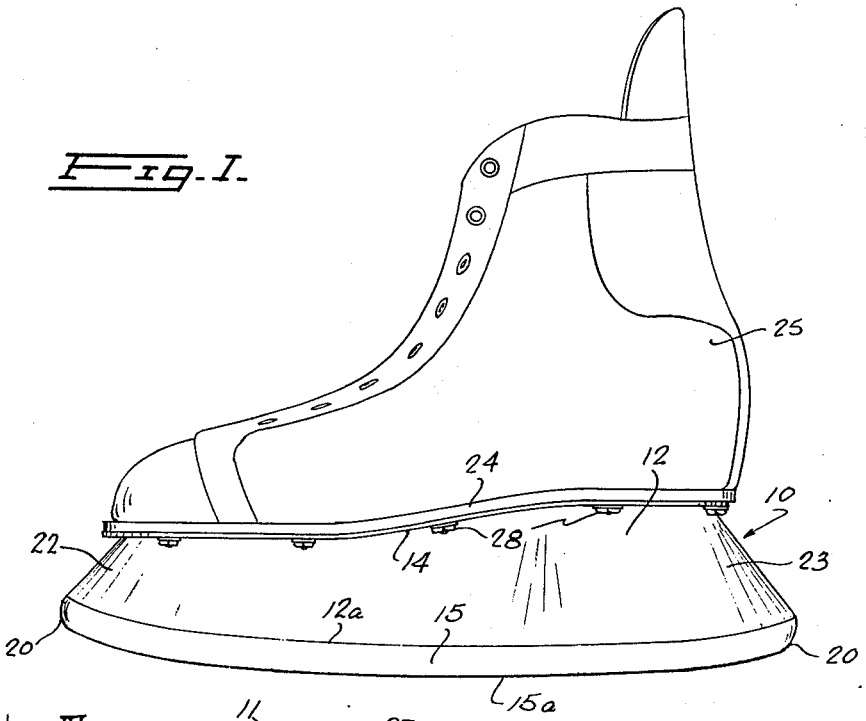
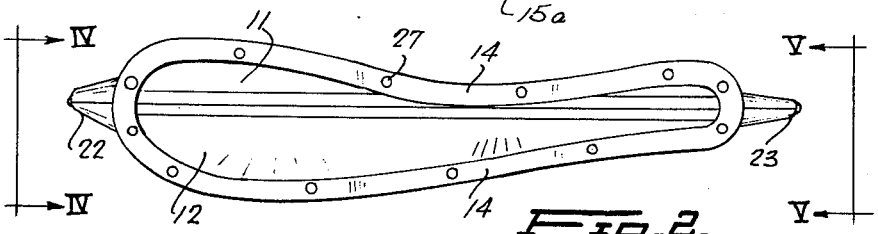
Fig. 2.
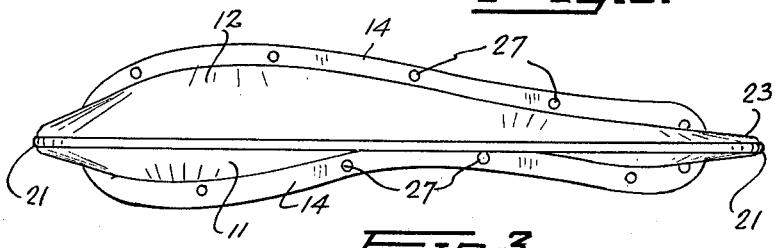
Fig. 3.
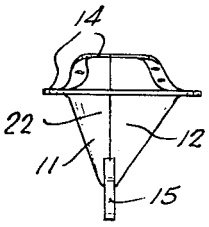
Fig. 4.
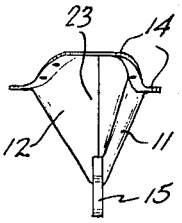
Fig. 5.

ICE SKATE

This invention relates to improvements in the construction of ice skates.

The principal objects of the various aspects of the present invention are to provide skates having at least some of the following desirable characteristics:

a. a blade support structure that is inherently stronger than in conventional skates;

b. a skate that is safer than conventional skates, especially in the avoidance of sharp edges on end surfaces of the blade and end surfaces of the skate structure generally;

c. a reduction in the number of pieces from which the skate is fabricated, especially when compared to the nine pieces from which a standard skate is assembled;

d. the use of welding or brazing as a method of securing the blade to the remainder of the structure, and the consequent avoidance of the need for rivets;

e. light weight, without sacrifice of strength;

f. a skate that is conveniently adapted to be readily attached to and detached from a boot for replacement purposes;

g. a skate construction that employs the sole of a boot to which it is attached as one structural element of a generally triangular arrangement of elements, thus permitting the skate itself to be of a less rigid construction than would otherwise be necessary;

h. as an alternative to (g) a combination skate and boot formed as a unitary structure from molded plastic material, either in one piece (except for the blade) or in two pieces joined together in a central vertical plane.

Applicant is aware of Canadian patent to G. Fletcher No. 109,404 issued Dec. 24, 1907 (corresponding U.S. Pat. No. 875,905 issued Jan. 7, 1908), which is believed to be the most closely related prior art. However, Fletcher's skate lacks many of the features of the present invention, both in the realm of safety and strength, as well as other desirable characteristics among those enumerated above, such as constructional convenience, as will appear more fully from the description that follows.

The accompanying drawings illustrate certain embodiments constructed in accordance with various aspects of the present invention, such embodiments being shown by way of example only. The broad scope of the present invention is defined by the appended claims.

In the drawings:

FIG. 1 is a side view of a first embodiment of skate attached to a boot;

FIG. 2 is a top plan view of the skate of FIG. 1 separated from the boot;

FIG. 3 is an underside view of FIG. 2;

FIG. 4 is a view on IV—IV in FIG. 2;

FIG. 5 is a view on V—V in FIG. 2;

FIRST EMBODIMENT (FIGS. 1-8)

Figure 8:
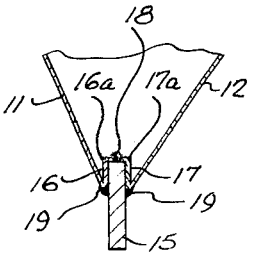
FIG. 8 is another fragment of FIG. 6 on an enlarged scale.

A skate 10 is formed of a pair of side wall members 11 and 12 which diverge upwardly from a blade-receiving socket 13 to define a peripheral, outwardly projecting flange 14. A blade 15 of hardened steel is secured in the socket 13. While the walls 11 and 12 may be made of a unitary piece of material (metal or plastic), the preferred arrangement is that shown in FIG. 8 in which the socket 13 is formed between upturned lower edge portions 16 and 17 of separate, stainless steel, wall members 11 and 12 respectively, such portions 16, 17 terminating in inturned edges **16*a*, 17*a* that define a gap between them in which a welding bead 18 is formed to secure these members to each other and to the top edge of the blade 15. Further welding beads 19 also serve to secure these parts together. These operations of securing the wall members 11 and 12 together and to the blade 15** can alternatively be accomplished in a single brazing operation.

As seen in FIG. 1 the running edge **15*a* of the blade 15 has a continuous, slight convex curvature, as is conventional in modern ice skates, such curvature being more pronounced at the ends. At each end the blade 15 is rounded both in side view (as seen at 20) and in plan view (as seen at 21), such rounding avoiding sharp edges at the ends of the skate that might prove dangerous to the user or others on the ice. For the same purpose, the ends of the walls 11, 12 are smoothly rounded off at 22 (front) and 23 (rear). The contour of the lower edges of the wall members 11, 12 (as shown at 12*a* in FIG. 1) follows the curved contour of the blade edge 15*a***.

Figure 7:
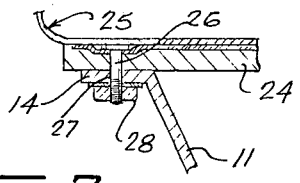
FIG. 7 is a fragment of FIG. 6 on an enlarged scale.
Figure 6:
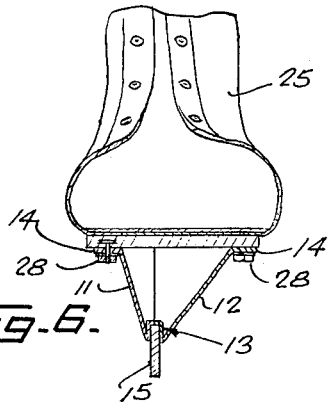
FIG. 6 is a section on VI—VI in FIG. 1.

While the sole 24 of the boot 25 can be secured to the skate in a variety of removable or permanent ways, e.g. by screws, bolts or rivets, the method shown in FIGS. 1, 6 and 7 involves the formation of a series of bolts 26 embedded in the sole structure to project downwardly therefrom and through holes 27 in the flange 14 to be secured thereto by nuts 28. This removable arrangement permits a new skate to be fitted to an old boot that still has some servicable life remaining, if the blade of the original skate has been worn down by continual sharpening to an extent requiring replacement.

When the skate and boot are thus assembled, as shown in FIGS. 1 & 6, a combination is formed that in transverse section has a triangular shape, the sides of such triangle being the wall members 11, 12 and the sole 24, which latter thus acts as one of the structural members imparting strength to the assembly. This reliance on the sole 24 to provide strength permits the wall members 11, 12 to be made of thinner material and hence to be lighter than would be necessary if they were required to provide the necessary rigidity alone.

Another important factor in providing an especially strong but nevertheless light assembly is the continuous curvature of the blade 15. In use, the lower part of the skate will often be subjected to large forces acting transversely on the blade 15, i.e. tending to rotate such blade about a front-to-rear, horizontal axis, either by rupture of the welds or by bending of the wall members 11, 12 and/or their portions 16, 17. The longitudinal curvature of the blade 15 and the socket 13 in which it is engaged substantially strengthens the resistance of the parts forming this socket to resist such bending forces.

This feature of strength through curvature is combined in the skate shown in FIGS. 1–8 with the inherent strength, especially against bending of the blade in its longitudinal direction, i.e. about one or more vertical axes, that the triangular sectional shape affords. Hence these two features cooperate to produce an especially strong skate, resistant to the types of bending experienced in use, and yet of comparatively light weight.

ALTERNATIVES (FIGS. 9 AND 10)

Figure 9:
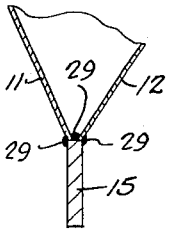
FIG. 9 is an alternative to the construction of FIG. 8.

FIG. 9 shows an alternative manner in which the blade 15 can be secured by welding beads 29 to wall members 11, 12.

Figure 10:
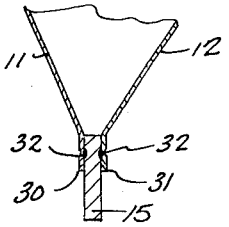
FIG. 10 is a further alternative to FIG. 8.
Figure 11:
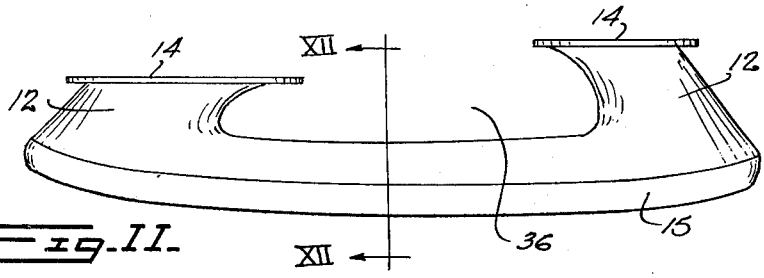
FIG. 11 is a side view of a second embodiment of skate, being a modification of the skate seen in FIG. 1.
Figure 12:
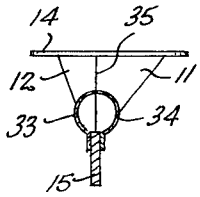
FIG. 12 is a section on XII—XII in FIG. 11.

FIG. 10 shows another similar alternative in which the wall members 11, 12 have flanges 30, 31 that are spot welded to the blade 15 at spots 32 along the blade.

SECOND EMBODIMENT (FIGS. 11 AND 12)

The second embodiment of skate is the same at each end as the skate of FIGS. 1 to 8, i.e. with wall members 11 and 12 terminating in flanges 14 so that the front and heel portions of the boot sole, when in place, each forms a triangular structure similar to that shown in FIG. 6.

Centrally of the longitudinal direction of the skate, the wall members 11, 12 are bent inwardly at 33, 34 and reduced in size to abut and be welded to each other along a central line 35. In this way the strength of support of the blade against bending is maintained throughout its length, while a transverse aperture 36 is formed in the body of the skate to reduce the amount of material and hence the weight of the article.

Thus, while the triangular structure of wall members and boot sole is an important feature of the present invention, it is not necessary that this structure be maintained throughout the entire length of the skate, provided it obtains in the front and rear areas beneath the ball of the foot and the heel respectively.

COMBINATION BOOT & SKATE (FIGS. 13 AND 14)

Figure 13:
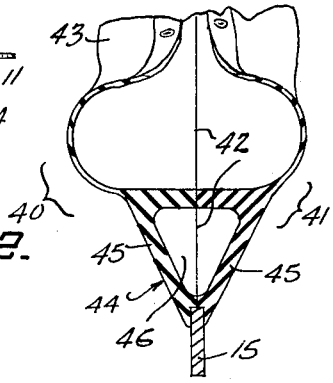
FIG. 13 is a transverse section through a further modification, being a combination boot and skate.

FIG. 13 shows an assembly formed from two members 40 and 41 joined together along a central line 42, the members 40 and 41 being approximately mirror images of each other. Each of these members is formed by injection molding a suitable plastic material, such as a polyurethane. They are then bonded together at 42 and to a hardened steel blade 15 that they support, such members being shaped to define a boot portion 43 and a support portion 44 that is triangular in cross-section, having side walls 45 on each side of a longitudinal cavity 46.

Figure 14:
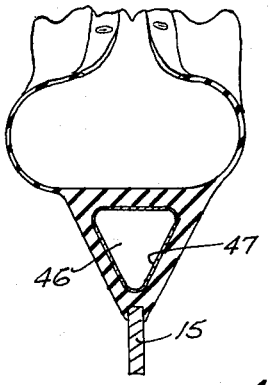
FIG. 14 is a view similar to FIG. 13 of a still further modification.

The variant of this arrangement shown in FIG. 14 is injection molded in a single piece, for which purpose a core tube 47 of light weight cardboard or the like has been left in place defining the cavity 46. If it is preferred to remove the tube 47, one or both of the ends of the plastic assembly can be removed to gain access to the cavity 46 after which such plastic end portion or portions can be fixed back in place again. In this construction, the blade 15 can be molded in place.

If preferred, instead of bonding the blade to the plastic material or molding it in place, the blade can first be secured, e.g. by welding or rivets, to a metal cylinder which is in turn molded into the plastic material.

This one or two piece type of construction with the boot and skate formed in an integrated manner out of a plastic material is believed especially well adapted to children's skates.

I claim:

1. A skate comprising a. a blade curved throughout its length in a longitudinal plane to define a convex running edge, b. a pair of wall members having lower edges connected to said blade throughout its length, c. said wall members extending upwardly from said blade while diverging from each other, and d. horizontal flanges extending from upper edges of said wall members for securing to a boot sole to form in cross-section a triangular structure therewith at least at front and rear portions of the skate, e. wherein said wall members have upturned, vertically extending, lower edge portions abutting side portions of the blade with inturned, horizontally extending edges abutting an upper surface of the blade, said upturned portions and inturned edges, copperating to form an elongated socket having a curvature corresponding to that of said blade, said blade being secured within said socket.

2. A skate according to claim 1, wherein said blade has a uniform width throughout its entire vertical dimension.

3. A skate according to claim 1, wherein said wall members diverge from each other from the blade to said upper edges throughout the entire length of the skate, the spacing apart of said upper edges increasing continuously from the rear portion to the front portion of the skate.

4. A skate according to claim 1, wherein said wall members converge to form a blunt rounded end surface at each end of the skate, each said rounded end surface being substantially vertically aligned with an end of the blade whereby penetration of an object struck by a blade end is essentially limited to the rounded end surface of the wall structure.

5. A skate according to claim 1, wherein said wall members converge to form a blunt rounded end surface at each end of the skate, each said rounded end surface defining a blunt edge sloping upwardly and longitudinally inwardly towards said boot sole, each end of the blade terminating flush with a sloping line defined by a respective said blunt edge.

6. A skate comprising a. a blade curved throughout its length in a longitudinal plane to define a convex running edge, and b. a pair of wall members diverging upwardly from said blade for securing to a boot sole, c. said wall members having upturned, vertically extending, lower edge portions abutting side portions of the blade with inturned, horizontally extending edges abutting an upper surface of the blade, said upturned portions and inturned edges cooperating to form an elongated socket having a curvature corresponding to that of said blade and within which said blade is secured, d. wherein said blade has a uniform width throughout its entire vertical dimension.

7. A skate according to claim 6, wherein said wall members converge to form a blunt rounded end surface at each end of the skate, each said rounded end surface being substantially vertically aligned with an end of the blade whereby penetration of an object struck by a blade end is essentially limited by the rounded end surface of the wall structure.

8. A skate according to claim 6, wherein said wall members converge to form a blunt rounded end surface at each end of the skate, each said rounded end surface defining a blunt edge sloping upwardly and longitudinally inwardly towards said boot sole, each end of the blade terminating flush with a sloping line defined by a respective said blunt edge.

9. A skate comprising a. a blade, b. an upwardly diverging wall structure rigidly connected to said blade and having means for securing to a boot sole, c. said wall structure having outer surfaces that extend between the blade and the securing means while extending forwardly along both sides of each end of the skate to converge and come together to form a blunt rounded end surface constituting an integral part of the wall structure, d. each said blunt end surface being smoothly rounded in a plane normal to the said outer surfaces, and e. each said rounded end surface being substantially vertically aligned with an end of the blade whereby penetration of an object struck by a blade end is essentially limited by a said rounded end surface.

10. A skate according to claim 9, wherein said wall structure comprises a pair of wall members having lower edges connected to said blade, said wall members extending upwardly from said blade while diverging from each other, said securing means comprising horizontal flanges extending from upper edges of said wall members for securing to a boot sole to form in cross-section a triangular structure therewith at least at front and rear portions of the skate.

11. A skate comprising a. a blade, b. an upwardly diverging wall structure rigidly connected to said blade and having means for securing to a boot sole, c. said wall structure having outer surfaces that between the blade and the securing means while extending forwardly along both sides of each end of the skate to converge and come together to form a blunt rounded end surface constituting an integral part of the wall structure, d. each said blunt end surface defining a line sloping upwardly and longitudinally inwardly from the blade to the securing means, e. each said blunt end surface being smoothly rounded in a plane normal to said line, and f. each end of the blade terminating flush with a respective said line.

12. A skate according to claim 11, wherein said wall structure comprises a pair of wall members having lower edges connected to said blade, said wall members extending upwardly from said blade while diverging from each other, said securing means comprising horizontal flanges extending from upper edges of said wall members for securing to a boot sole to form in cross-section a triangular structure therewith at least at front and rear portions of the skate.

* * * * *